United States Patent [19]

Bailey

[11] Patent Number: 5,032,447

[45] Date of Patent: Jul. 16, 1991

[54] FIRE BARRIER MATERIAL

[76] Inventor: Douglas J. Bailey, 397 Washington, Snyder, N.Y. 14227

[21] Appl. No.: 204,064

[22] Filed: Jun. 8, 1988

[51] Int. Cl.[5] ..... B32B 3/28; B27N 9/00

[52] U.S. Cl. ..... 428/184; 428/74; 428/75; 428/121; 428/126; 428/152; 428/167; 428/172; 428/192; 428/213; 428/215; 428/284; 428/285; 428/920; 428/921; 52/450; 52/674; 52/795

[58] Field of Search ..... 428/182, 184, 192, 152, 428/179, 285, 215, 284, 212, 213, 126, 124, 121, 920, 921, 210, 70, 74, 75, 76, 167, 172; 52/450, 452, 454, 785, 795, 801, 814, 657, 671, 674, 309.16

[56] References Cited

U.S. PATENT DOCUMENTS

| | | | |
|---|---|---|---|
| 2,840,500 | 6/1958 | Okoomian et al. | 428/184 |
| 4,089,324 | 5/1978 | Tjaden | 428/184 |
| 4,157,929 | 6/1979 | Kubicek | 428/184 |
| 4,172,164 | 10/1979 | Meyer et al. | 428/184 |
| 4,227,356 | 11/1980 | Stern et al. | 52/674 |
| 4,259,092 | 3/1981 | Matsuo et al. | 428/184 |
| 4,401,706 | 8/1983 | Sovilla | 428/184 |
| 4,789,585 | 12/1988 | Saito et al. | 428/184 |

*Primary Examiner*—Ellis P. Robinson
*Assistant Examiner*—Donald J. Loney

[57] ABSTRACT

A fire barrier material for use in building construction comprising a sandwich structure have a first and second outer layers comprising a high temperature resistant material having corrugations therein and an intermediate layer comprising a flame retardant fibrous material wherein the corrugation are positioned in the outer layers in a manner which enables the barrier material to be rolled into a bundle in a direction substantially perpendicular to the direction of the corrugations.

13 Claims, 2 Drawing Sheets

FIRE BARRIER MATERIAL

BACKGROUND OF THE INVENTION

The present invention is directed to a fire barrier for use in building construction. In particular, the present invention is directed to a fire barrier material used in conjunction with wall, ceiling or floor expansion joint systems to aide in the substantial reduction of the chimney effect associated with buildings having these types of expansion joints.

Architects and engineers today must take into account the effects not only of seismic movement, but also those movements caused by building sway, settlement, thermal expansion and contraction. Architects know that any building that may be subjected to ground oscillations must be designed to control and accommodate movement caused by resonation within the structure while additionally providing for tower sway, thermal movement and settlement.

Architects and engineers have designed buildings with various expansion joints between the walls, ceilings and floors to take into account the sway, ground motion, settlement, etc. associated with buildings. However, a disadvantage of the use of expansion joints is that they create a chimney effect in the building structure. Because fire is an ever-present danger in association with any building and the chimney effect at unprotected expansion joints may actually advance a spread, it is highly desirable to utilize a fire barrier in conjunction with any expansion joint assembly to provide additional protection to aid in the prevention of the spreading of any fire. Typically, fire barriers are comprised of wire mesh reinforced with a suitable fire retardant material. This mesh reinforced wire is positioned between the joint prior to the application of the expansion joint assembly. The fire barrier is a highly thermal resistant material which protects the joint from the associated chimney effect within the building construction. Other types of joint treatment systems have included insulated metal foil (i.e. aluminum) layers such as those disclosed in the Fire Resistant Directory, pages 718–721 and 821–823. While these fire resistant barrier layers are suitable for reduction in the chimney effect associated with buildings containing expansion joints, they clearly can be improved. For example, these barrier structures are difficult to install and difficult to handle and ship. The present invention is directed to a barrier material which not only has improved fire resistant properties but also can be easily handled and installed.

SUMMARY OF THE INVENTION

It is a primary object of the present invention to provide a novel fire barrier for use in building construction which is easily handled and shipped.

It is another object of the present invention to provide a fire barrier having improved fire resistance and capable of being installed by a single operator.

Additional objects and advantages of the invention have been set forth in part in the description which follows and in part will be obvious from the description or may be learned by practice of the invention. The objects and advantages of the invention may be realized and obtained by means of the instrumentalities and combinations particularly pointed out in the appended claims.

To achieve the foregoing objects and in accordance with the purpose of the invention as embodied and broadly described herein the fire barrier material of this invention comprises a sandwich structure comprising a first and second outside layers comprising corrugated high temperature resistant metal and at least one intermediate layer comprising a flame retardant fibrous material wherein the corrugations are positioned on the outside layers in an array which enables the barrier material to be rolled in a direction substantially perpendicular to the corrugations.

Preferably, the fire barrier material comprises a sandwich structure having a first and second outside layers having a thickness no greater than 7 mils comprising corrugated stainless steel with at least 2 score lines positioned substantially perpendicular to the corrugations, and at least one intermediate layer comprising ceramic fibrous material freely disposed within the outside layers wherein the corrugations on the outside layers are positioned in an array which enables the barrier layer to be rolled in a direction substantially perpendicular to the corrugations and terminate at a predetermined distance from the opposed edges of the outside layers.

In another preferred embodiment each outside layer has a thickness no greater than 5 mils, most especially a thickness of between 3–5 mils.

In a further preferred embodiment of the present invention the fire retardant material comprises ceramic fibers, especially preferred are ceramic silicates, most especially preferred being alumina silicate.

In still another preferred embodiments of the present invention the outside layers comprise at least two substantially smooth strips of high temperature resistant metal attached to the opposed edges of a strip of corrugated high temperature resistant metal.

In a further preferred embodiment of this aspect of the present invention the smooth strips and corrugated strip are attached to one another in a manner which produces a continuous outside layer having substantially the same thickness throughout.

The fire barrier of the present invention allows for easy installation and configuration to the expansion joint by a single worker. The corrugated portion of the outside layers allow one to roll the barrier material into a neat bundle easily facilitating its shipping and handling. The score lines perpendicular to the corrugation allow for easy manipulation by installers to conform to the configuration of the expansion joint. The fire barrier of the present invention can be readily installed by single operator greatly reducing the labor intensive process hereby associated with prior barrier materials.

A BRIEF DESCRIPTION OF THE DRAWINGS

The invention consist of the novel parts, construction, arrangements, combinations and improvements shown and described. The accompanying drawings which are incorporated and constitute a part of the specification illustrate one embodiment of the invention and together with the description serve to explain the principles of the invention.

Of the drawings:

FIG. 1A is an enlarged cross sectional view of the fire barrier material.

DETAILED DESCRIPTION OF THE INVENTION

Reference will now be made in detail in the present preferred embodiments of the invention an example of which is illustrated in the accompanying drawings.

While the invention will be described in connection with the preferred embodiments, it should be understood that this description is not intended to limit the invention to that particular embodiment. On the contrary, it is intended to cover all alternatives, modifications and equivalents as may be included within the spirit and scope of the invention as defined in the appended claims.

Figure 1:
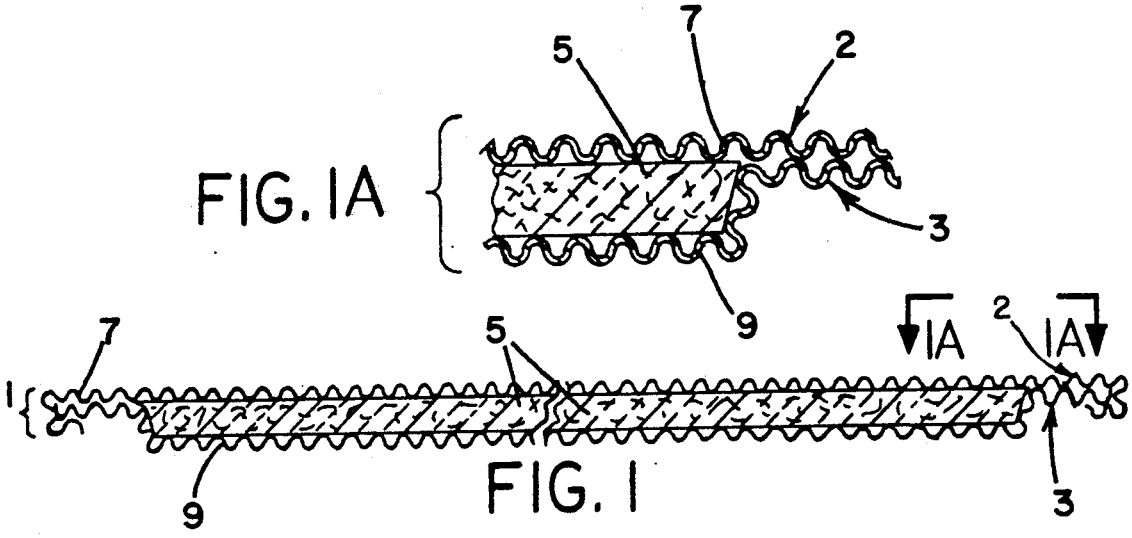
FIG. 1 is a cross sectional view of the fire barrier material of the present invention.

With reference to FIG. 1, the fire barrier material of the present invention comprises a sandwich structure 1 comprising a first and second outside layers 2 and 3 made from corrugated high temperature resistant metal and at least one intermediate layer 5 comprising a flame retardant fibrous material. The corrugations 7 and 9 located in outer layers 2 and 3, respectfully, are positioned in outside layers 2 and 3 in an array enabling the barrier material to be rolled in a direction perpendicular to the corrugations.

Preferably, outer layers 2 and 3 are made of a high temperature resistant metal such as stainless steel or an Inconel alloy and are of a thickness so that they may be rolled easily. Preferably, the thickness of outside layers 2 or 3, respectfully, is not greater than 7 mils. Most preferably the thickness of layers 2 and 3 is not greater than 5 mils and especially preferred is a range of between about 3–5 mils.

The fire retardant fibrous material comprising layer 5 is preferably a ceramic fibrous material. Most preferably, the fibrous material is a paper-like product comprising ceramic fiber, in particular alumina silicate. This material can readily be purchased under the trademark FIBERFRAX from The Standard Oil Engineered Materials Corporation.

As depicted in FIG. 1 the preferred configuration of the barrier material is rectangular and the corrugations in outer layers 2 and 3 are in a direction parallel to the width of the barrier material 1. Fibrous material comprising layer 5 is freely disposed between outside layers 2 and 3. By the term "freely" it is meant that the fibrous material is not adhesively attached to layers 2 and 3. That is, the fibrous material is merely laid down or positioned within outside layers 2 and 3 prior to connecting the outside edges of 2 and 3 to one another to form the sandwich structure. It should be understood that the fibrous material comprising layer 5 can in fact be made by applying more than one layer of fibrous material between outside layers 2 and 3 until layer 5 has the appropriate thickness.

In a preferred embodiment of the present invention corrugations 7 and 9 terminate at a predetermined distance from at least two edges of outside layers 2 and 3 of barrier material 1 providing barrier material 1 with at least two surfaces adjacent to the edges of barrier layer 1 which are free of corrugations. Most preferably, these surfaces extend equidistance from the opposed edges of the outside layers 2 and 3. Typically, the smooth surface areas running along the opposed edges of barrier layer 1 measures about 2 inches in width from the opposed edge. These smooth surfaces provide the barrier material with a capability of forming a tight or flush seal across the expansion joint. This flush or tight seal along the expansion joint is also important because it eliminates any chimney effect associated with the expansion joint.

Figure 2A:
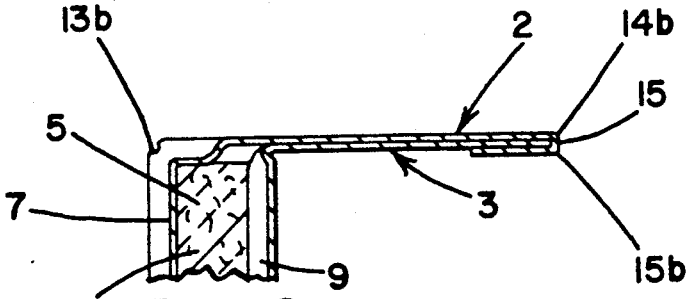
FIG. 2A is an enlarged cross sectional view of the fire barrier bent along score lines to conform to the shape of the material as placed in an expansion joint.
Figure 2:
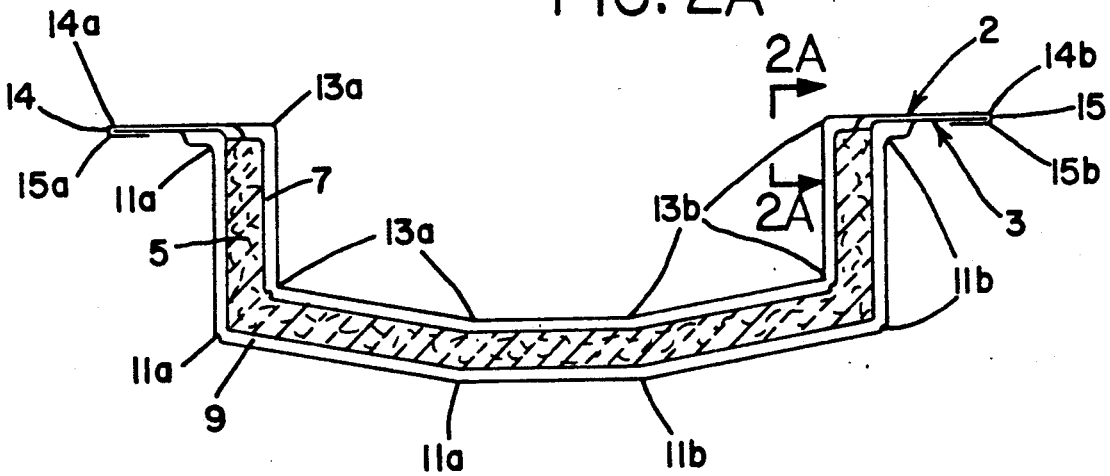
FIG. 2 is a cross sectional view of the fire barrier bent along score lines to conform to the shape of the material as placed in an expansion joint.

With reference to FIG. 2, the barrier layer of the present invention is depicted with barrier material 1 being shaped along score lines 11(*a*) and (*b*) and 13(*a*) and (*b*). The score lines are preferably placed equidistant from opposed edges 14(*a*), 14(*b*), 15(*a*) and 15(*b*) located on outside layers 2 and 3 respectively. The score lines are substantially perpendicular to the corrugation in layers 2 and 3. It is the function of the score lines to provide the installer with a means to easily conform the fire barrier to the opening where the expansion joint is to be position. Usually, the fire barrier is conformed in a u-shape as depicted in FIG. 2 and then placed between the opening in the joint with edges 14 and 15 overlapping the surfaces of the wall, ceiling or floor panel.

In a preferred embodiment of the present invention, edges 14 and 15 are securely mounted to the floor or surface panels by means of a fastening element such as a screw.

It is important to the practice of the present invention that corrugations 7 and 9 in layers 2 and 3 should terminate at a predetermined distance from the opposed edges 14 and 15 respectively to enable a tight or flush seal between the fire barrier and the wall, ceiling or floor panels.

It should be understood that the score lines and corrugation which are formed in layers 2 and 3 can be made by any conventional procedure known in the prior art. For example, corrugation can be made by molding or stamping procedures and scoring can be done by conventional stamping procedures. The particular means of forming the corrugations and score lines does not form any part of the present invention.

While the individual outside layers 2 or 3 may be made from a single continuous strip of high temperature resistant material it is preferred that the outside layer be formed by combining more than one strip or piece of high temperature material. For example, in a preferred embodiment of the present invention the outer layer 3 can comprise at least two substantially smooth strips of high temperature resistant material attached to the opposed edges of a strip of corrugated high temperature resistant material. This embodiment is shown in FIG. 3.

Figure 3:
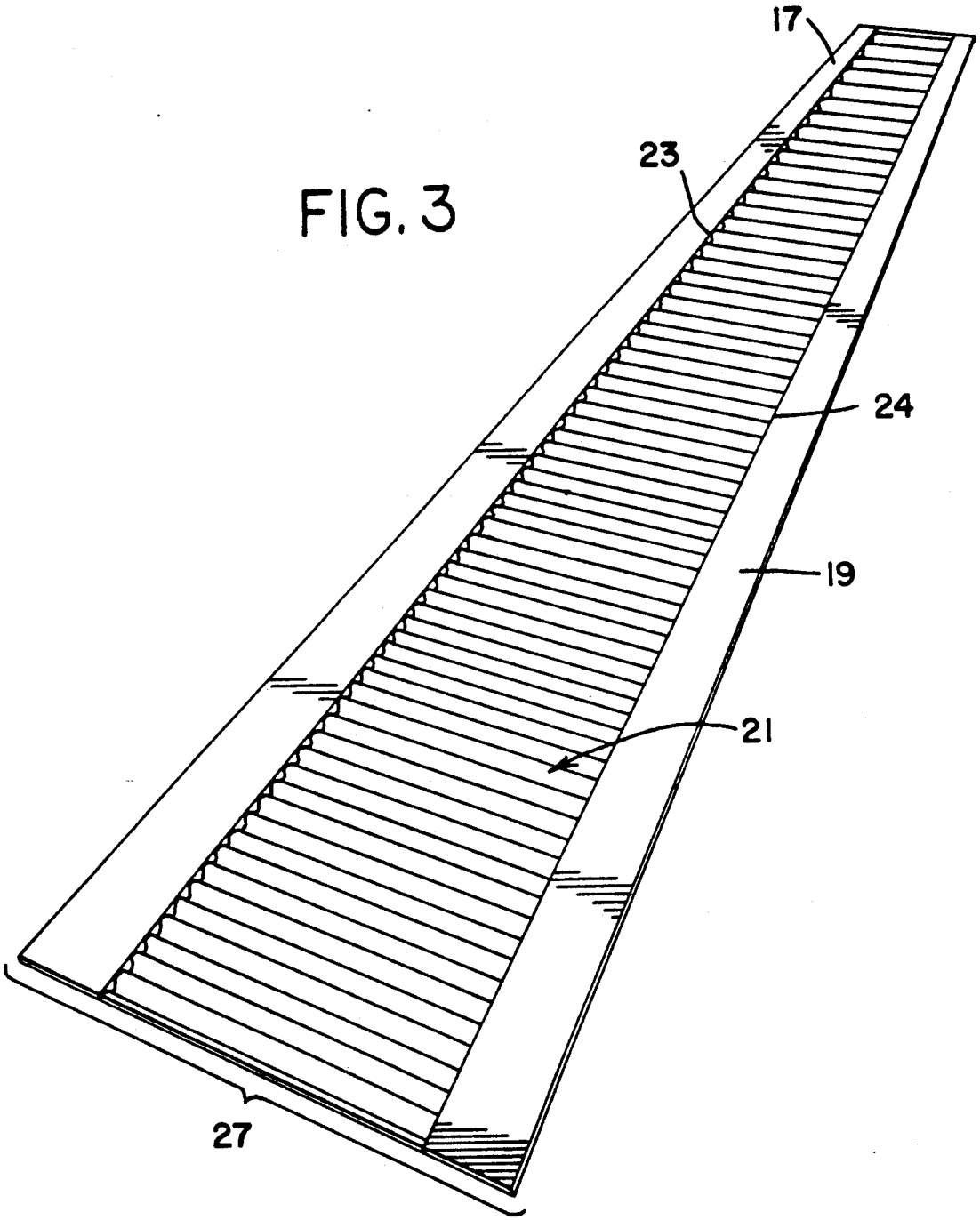
FIG. 3 is a perspective view of a single outside layer used in the manufacture of the fire barrier of the present invention.

Referring to FIG. 3, separate smooth (i.e. non-corrugated) heat resistant material strips 17 and 19 (preferably stainless steel) are attached along the opposed edges 23 and 24 of corrugated heat resistant material 21 (stainless steel) to form an outer layer 27 of barrier material 1. Strips 17 and 19 may be tack welded to corrugated material 21 although other means of attaching may be utilized. It should be understood that strips 17 and 19 should have substantially the same overall thickness as strip 21 in order that the outer layer 27 possess substantially the same overall thickness throughout. Typical dimension for outer layer 27 (or layer 2 and 3 as shown in FIGS. 1 and 2) are 20 feet long by 6" wide with a thickness of no greater than 7 mils. In this typical example strips 17 and 19 could be 1 inch wide and strip 21 could be 4 inches wide. Usually, the width of strips 17 and 19 will be selected to be the same and the width of strip 21 will be greater than the combined width of strips 17 and 19. Of course, various other widths and lengths may be chosen depending on the specific size of the expansion joint.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principals of the invention and is practical application to thereby enable others skilled in the art to best utilize the invention in various embodiments and with various modifications as are suited to the particular use contemplated. It is intended that the scope of the invention be defined by the claims appended hereto.

What we claim is:

1. A fire barrier material for use in building construction comprising a flexible sandwich structure comprising a first and second corrugated outside layers comprising high temperature resistant metal possessing at least two score lines located on at least one of said outer layers and running in a direction substantially perpendicular to said corrugations and an intermediate layer comprising a freely disposed flame retardant fibrous material wherein said corrugations are positioned in said outside layer in an array enabling said barrier material to be rolled in a direction perpendicular to said corrugations.

2. The barrier material of claim 1 wherein said score lines are located equidistant from the opposite edges of said barrier material.

3. The barrier material of claim 2 wherein said opposite edges are located along the length of said barrier material.

4. The barrier material of claim 3 wherein said outside metal layers comprise stainless steel.

5. The barrier material of claim 4 wherein said flame retardant material comprises ceramic fibers.

6. The barrier material of claim 5 wherein said ceramic fibers are alumina-silicate.

7. The barrier material of claim 6 wherein said outside layer comprises at least two smooth high temperature resistant metal strips attached to the opposed edges of a strip of corrugated high temperature resistant metal.

8. A fire barrier material for use in building construction comprising a sandwich structure comprising a first and second outside layers comprising corrugated stainless steel having a thickness not greater than 7 mils and an intermediate layer comprising ceramic fibrous material freely disposed between said outside layers, said corrugation position in said outside layers and terminating at a predetermined distance from the opposed edges located along the length of said barrier material.

9. The barrier material of claim 8 wherein said ceramic fibrous materials is alumina-silicate.

10. The barrier material of claim 9 wherein said outside layers have a thickness no greater than 5 mils.

11. The barrier material of claim 10 wherein said outside layers have a thickness of between 3 to 5 mils.

12. The barrier material of claim 11 wherein said ceramic fibrous material is alumina-silicate.

13. The barrier material of claim 12 wherein said outside layer comprises at least two smooth high temperature resistant metal strips attached to the opposed edges of a strip of corrugated high temperature resistant metal and extending therefrom.

* * * * *